United States Patent [19]

Bracknell

[11] 4,237,615

[45] Dec. 9, 1980

[54] SIGHT MOUNT FOR AN ARCHERY BOW

[75] Inventor: Paul A. Bracknell, Tuscaloosa, Ala.

[73] Assignee: Thomas H. Hudson, Hueytown, Ala. ; a part interest

[21] Appl. No.: 968,103

[22] Filed: Dec. 11, 1978

[51] Int. Cl.[3] ..... F41G 1/46

[52] U.S. Cl. ..... 33/265

[58] Field of Search ..... 33/265, 246, 247

[56] References Cited

U.S. PATENT DOCUMENTS

| | | | |
|---|---|---|---|
| 2,351,103 | 6/1944 | Brown | 33/265 |
| 2,629,176 | 2/1953 | Ivy | 33/248 |
| 2,715,275 | 8/1955 | Kipp | 33/248 |
| 2,830,373 | 4/1968 | Dahlberg | 33/248 |

*Primary Examiner*—Steven L. Stephan

*Attorney, Agent, or Firm*—Woodford R. Thompson, Jr.

[57] ABSTRACT

A sight mount for an archery bow embodying a bracket adapted to be mounted upon a bow. A sight support is mounted on the bracket for pivotal movement in a plane parallel to a plane extending longitudinally through the bow on which the bracket is mounted. Adjustment members are mounted on the bracket at opposite sides of the sight support with one adjustment member yieldably engaging the sight support to restrain pivotal movement thereof in one direction. A movable member is carried by the other adjustment member and is movable to selected positions toward and away from the sight support to hold the sight support at selected angular positions relative to the bracket.

2 Claims, 8 Drawing Figures

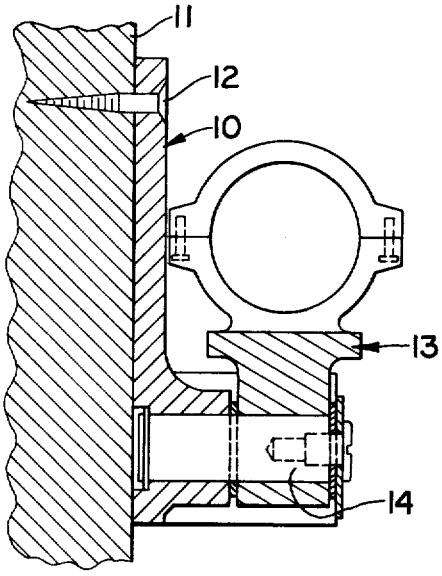
FIG. 3
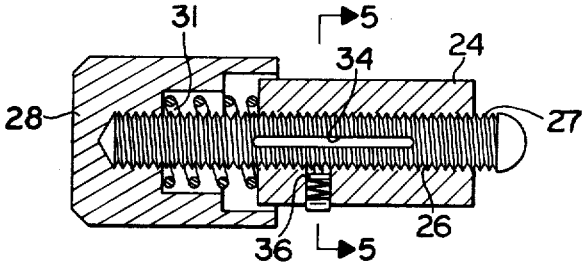
FIG. 4
FIG. 5
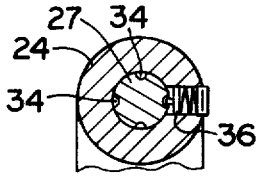
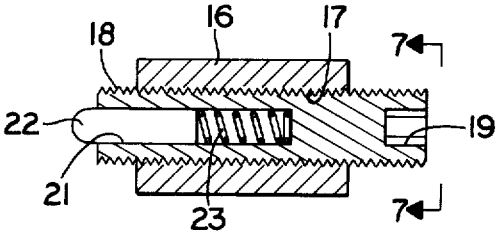
FIG. 6
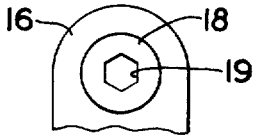
FIG. 7
FIG. 8
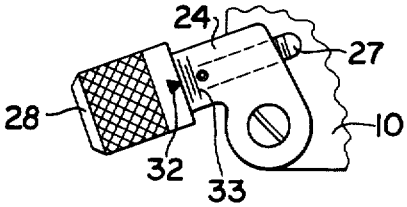

SIGHT MOUNT FOR AN ARCHERY BOW

BACKGROUND OF THE INVENTION

This invention relates to a sight mount for an archery bow and more particularly to means for mounting a telescopic sight upon an archery bow whereby the sight is held accurately at selected angular positions in a vertical plane parallel to a plane extending longitudinally and forwardly through the bow on which the sight is mounted.

As is well known in the art to which my invention relates, many devices have been proposed for mounting telescopic sights on archery bows, guns and the like. However, such devices have been unsatisfactory due to the fact that they do not provide quick and accurate means for adjusting the angular position of the sight relative to the bow and at the same time provide means for holding the sight in the adjusted position during aiming and shooting.

Prior art sight devices for archery bows and guns with which I am familiar are disclosed in the Brown U.S. Pat. No. 2,351,103, the Tate U.S. Pat. No. 2,163,503 and the Braithwaite U.S. Pat. No. 810,258.

SUMMARY OF THE INVENTION

In accordance with my present invention, I provide a sight mount for an archery bow which may be attached to a conventional bow with a minimum of time and effort and without having to modify the bow. Also, my improved sight mount may be quickly and accurately adjusted to position the sight at a selected angular position whereupon the mount and the sight carried thereby are then held in the proper position during aiming and shooting.

My improved sight mount embodies a bracket which is adapted to be mounted upon an archery bow at the usual sight location on the bow. A sight support is mounted on the bracket for pivotal movement in a vertical plane parallel to a plane extending longitudinally and forwardly through the bow on which the bracket is mounted. Adjustment members are mounted with one adjustment member yieldably engaging the sight support to restrain pivotal movement thereon in one direction while a movable member carried by the other adjustment member is movable to selected positions toward and away from the sight support to hold the sight support at selected angular positions relative to the bracket.

DESCRIPTION OF THE DRAWINGS

A sight mount embodying features of my invention is illustrated in the accompanying drawings, forming a part of this application, in which:

FIG. 3 is a sectional view taken generally along the line 3—3 of FIG. 2;

FIG. 4 is an enlarged, sectional view taken generally along the line 4—4 of FIG. 2;

FIG. 5 is a sectional view taken generally along the line 5—5 of FIG. 4;

FIG. 6 is an enlarged, sectional view taken generally along the line of 6—6 of FIG. 2;

FIG. 7 is an end view taken along the lines 7—7 of FIG. 6; and,

FIG. 8 is a fragmental view showing the means for indicating the amount of rotation of the knob-like member relative to the adjacent portion of the adjustment member.

DETAILED DESCRIPTION

Figure 1:
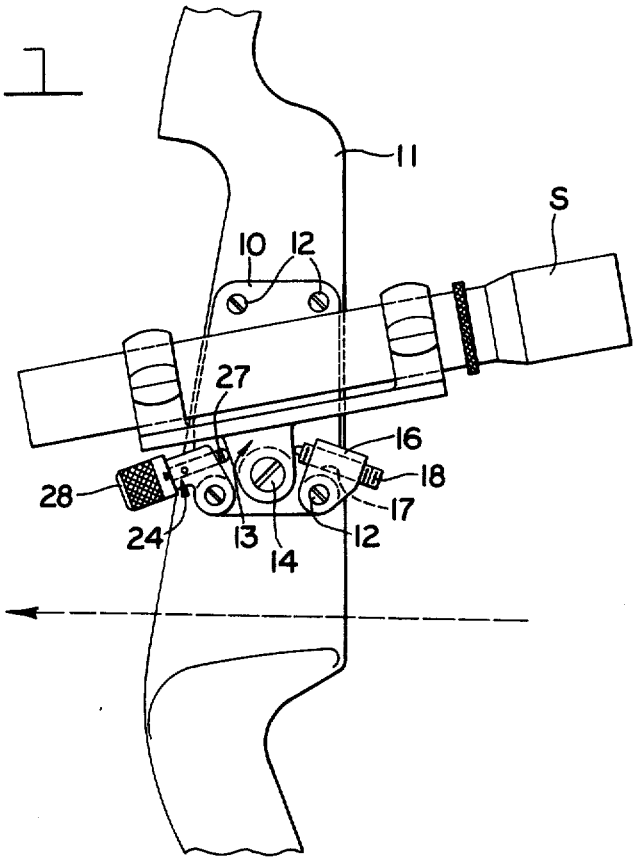
FIG. 1 is a side elevational view showing an intermediate portion of an archery bow having my improved sight mount mounted thereon and supporting a conventional type telescopic sight.
Figure 2:
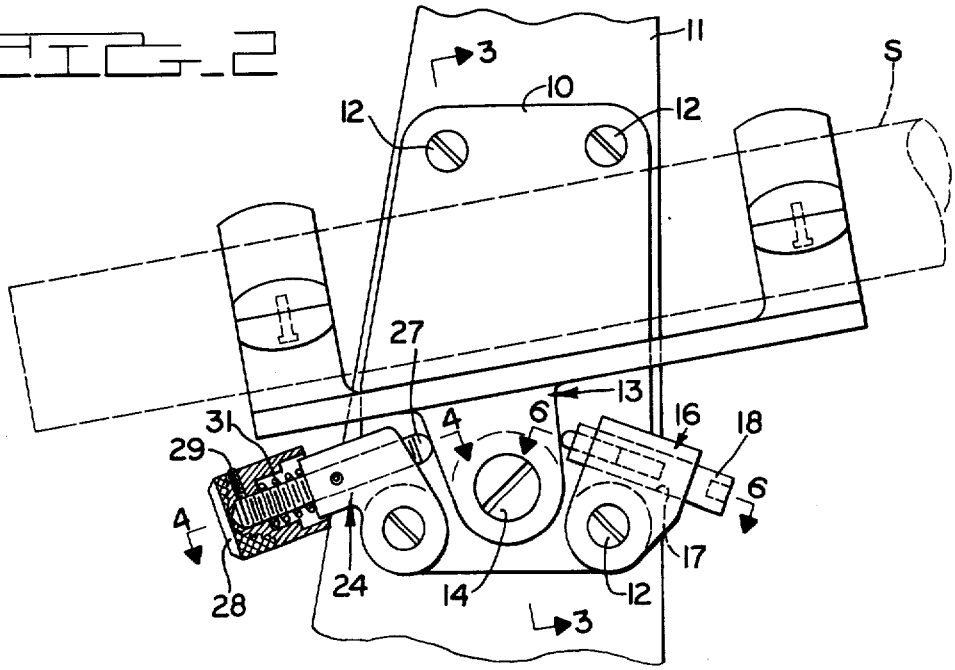
FIG. 2 is an enlarged, side elevational view, partly broken away and in section, showing more in detail the manner in which my improved sight mount is mounted on the bow.

Referring now to the drawings for a better understanding of my invention, I show an attachment bracket 10 which is adapted to be mounted upon a conventional type archery bow 11 by suitable means, such as screws 12, whereby the attachment bracket is secured rigidly to the bow 11. As shown in FIGS. 1, 2 and 3, a sight support member 13 is mounted for pivotal movement on the side of the attachment bracket 10 by a suitable pivot pin 14 which extends outwardly perpendicular to the adjacent side of the bow 11, as shown in FIGS. 1, 2 and 3, whereby the sight support member is adapted to move in a vertical plane parallel to a plane extending longitudinally and forwardly through the bow 11, the forward direction being indicated by an arrow in FIG. 1.

A first adjustment member 16 is mounted on the attachment bracket 10 at one side of the sight support member 13. The adjustment member 16 is provided with an elongated threaded opening 17 therethrough for receiving an elongated, externally threaded member 18, as shown in FIG. 6. A suitable tool receiving recess 19 is provided in the outer end of the elongated threaded member 18 for receiving a tool whereby the member 18 may be rotated to selected positions. An elongated, axially extending recess 21 is provided in the inner end of the elongated member 18 for receiving a movable element 22 which is adapted to engage an adjacent portion of the sight support member 13, as shown in FIGS. 1 and 2. A compression spring 23 is provided in the recess 21 between the inner end of the movable element 22 and the bottom of the recess 21 to urge the movable element 22 outwardly toward the adjacent side of the sight support member 13. Accordingly, the movable element 22 yieldably engages the sight support member 13 to restrain pivotal movement of the sight support member toward the adjustment member 16.

Mounted on the attachment bracket 10 at the opposite side of the sight support member 13 from the first adjustment member 16 is a second adjustment member 24 which is provided with a threaded opening 26 therethrough for receiving an elongated threaded element 27 which engages the sight support member 13 and is movable selectively in a direction toward and away from the sight support member 13 in response to rotation of the elongated threaded element 27 in opposite directions to thereby hold the sight support member 13 at a selected angular position relative to the attachment bracket 24. A knob-like member 28 is carried by the elongated threaded element 27 for imparting rotation thereto. The knob-like member 28 is secured to the threaded element 27 by suitable means, such as a locking screw 29. Also, a compression spring 31 surrounds the threaded element 27 between the knob-like member 28 and the adjacent end of the adjustment member 24 to restrain relative movement therebetween.

As shown in FIG. 8, suitable indicia, such as an arrow 32 is provided on the knob-like member 28 which is adapted to register with indicia, such as graduations 33, provided on the adjustment member 24 whereby the sight support member 13 may be moved accurately to selected angular positions in a vertical plane parallel to a plane extending longitudinally and forwardly through the bow 11 and then retained in the adjusted position. To further secure the elongated threaded element 27 against rotation relative to the adjustment bracket 24, I provide longitudinally extending recesses 34 in the elongated threaded element 28 at angularly spaced locations in position to receive a spring-loaded plunger 36 which is carried by the adjustment bracket 24. Accordingly, the elongated threaded element 27 is held at selected positions relative to the adjustment member 24.

From the foregoing, the operation of my improved sight mount for an archery bow will be readily understood. The attachment bracket 10 is secured rigidly to the archery bow 11 by means of the retaining screws 12 whereby the sight support member 13 carrying a conventional type telescopic sight "S" is adapted for pivotal movement in a plane parallel to a vertical plane extending longitudinally and forwardly through the bow 11. The threaded member 18 is rotated so as to position the inner end thereof in spaced relation to the adjacent side of the sight support member 13 whereby the spring loaded movable element 22 bears against the adjacent side of the sight support member 13. The elongated threaded element 27 is then rotated by turning the knob-like member 28 to thus move the inner end of the elongated threaded member 27 toward or away from the sight support member 13 whereby the sight support member 13 pivots about its pivot pin 14 to the desired location which is accurately indicated by the graduations on the outer portion of the adjustment member 24, as shown in FIG. 8. Accordingly, the sight support member 13 is moved accurately to a selected angular position relative to the bow 11 and is then retained in this set position during aiming and shooting.

From the foregoing, it will be seen that I have devised an improved sight mount for an archery bow. By providing a sight mount which may be quickly and accurately attached to a conventional type bow, without modification, my improved sight mount is extremely simple of construction, economical of manufacture and at the same time is adapted for use on various types of bows. Also, by providing adjustment members at opposite sides of the sight support member for moving the sight support member accurately to a selected angular position relative to the bow, the angular position of the sight may be quickly and accurately adjusted to a desired position and then retained in this position until readjusted by the archer.

While I have shown my invention in but one form, it will be obvious to those skilled in the art that it is not so limited, but is susceptible of various changes and modifications without departing from the spirit thereof.

What I claim is:

1. A sight mount for mounting a telescopic sight unit on an archery bow comprising:

(a) an attachment bracket adapted to be mounted upon a side of an archery bow which extends in a vertical plane parallel to a plane extending longitudinally and forwardly through the bow, (b) a sight support member for carrying said telescopic sight unit and mounted on said attachment bracket for pivotal movement in a vertical plane parallel to a plane extending longitudinally and forwardly through the bow on which said attachment bracket is mounted, (c) a first adjustment member mounted on said attachment bracket at one side of said sight support member and having an internally threaded opening therethrough, (d) an elongated externally threaded member in threaded engagement with said internally threaded opening through said first adjustment member and being movable selectively toward and away from said sight support member in response to rotation of said elongated externally threaded member in opposite directions, (e) there being an elongated recess extending axially within said elongated externally threaded member, (f) an elongated member mounted for axial movement in said elongated recess with one end thereof engaging said sight support member, (g) spring means interposed between said elongated member and the inner end of said elongated recess urging said elongated member into yieldable engagement with said sight support member to restrain pivotal movement of said sight support, (h) a second adjustment member mounted on said attachment bracket at the opposite side of said sight support member from said one side, and (i) a movable member carried by said second adjustment member and movable to selected positions toward and away from said sight support member to hold said sight support member and the telescopic sight unit carried thereby at selected angular positions relative to said attachment bracket and in a vertical plane parallel to a plane extending longitudinally and forwardly through the bow.

2. A sight mount for mounting a telescopic sight unit on an archery bow comprising:

(a) an attachment bracket adapted to be mounted upon a side of an archery bow which extends in a vertical plane parallel to a plane extending longitudinally and forwardly through the bow, (b) a sight support member for carrying said telescopic sight unit and mounted on said attachment bracket for pivotal movement in a vertical plane parallel to a plane extending longitudinally and forwardly through the bow on which said attachment bracket is mounted, (c) a first adjustment member mounted on said attachment bracket at one side of said sight support member yieldably engaging said sight support member to restrain pivotal movement of said sight support member toward said first adjustment member, (d) a second adjustment member mounted on said attachment bracket at the opposite side of said sight support member from said one side and having a threaded opening therethrough for receiving an elongated threaded element which engages said sight support member and is movable selectively in a direction toward and away from said sight support member in response to rotation of said elongated threaded element in opposite directions to thereby hold said sight support member and the telescopic sight unit carried thereby at selected angular positions relative to said attachment bracket and in a vertical plane parallel to a plane extending longitudinally and forwardly through the bow, (e) longitudinally extending recesses in said elongated threaded element at angularly spaced locations relative to each other, and (f) a spring loaded plunger carried by said second adjustment member in position to engage selected ones of said angularly spaced recesses whereby said elongated threaded member is held at selected positions relative to said second adjustment member.

* * * * *